US009310759B2

(12) United States Patent
Fukamachi

(10) Patent No.: US 9,310,759 B2
(45) Date of Patent: Apr. 12, 2016

(54) PROCESS CARTRIDGE PROVIDED WITH CLEANING UNIT

(71) Applicant: BROTHER KOGYO KABUSHIKI KAISHA, Nagoys-shi, Aichi-ken (JP)

(72) Inventor: Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/640,509

(22) Filed: Mar. 6, 2015

(65) Prior Publication Data

US 2015/0253726 A1 Sep. 10, 2015

(30) Foreign Application Priority Data

Mar. 7, 2014 (JP) ..... 2014-044938

(51) Int. Cl.
*G03G 15/08* (2006.01)
*G03G 21/18* (2006.01)

(52) U.S. Cl.
CPC ..... *G03G 21/1814* (2013.01)

(58) Field of Classification Search
CPC ..... G03G 15/0817; G03G 15/0898; G03G 15/0812; G03G 15/0882; G03G 2221/1648; G03G 15/0808
See application file for complete search history.

(56) References Cited

U.S. PATENT DOCUMENTS

| | | | | |
|---|---|---|---|---|
| 5,475,467 | A * | 12/1995 | Watanabe et al. | 399/111 |
| 5,937,251 | A * | 8/1999 | Suzuki | 399/253 |
| 2004/0136746 | A1* | 7/2004 | Komatsu et al. | 399/104 |
| 2012/0195663 | A1* | 8/2012 | Tosuji G03G | 21/0058 399/353 |
| 2012/0308265 | A1* | 12/2012 | Hashimoto et al. | 399/167 |
| 2013/0108322 | A1 | 5/2013 | Nishimoto | |
| 2014/0037326 | A1 | 2/2014 | Hashimoto | |

FOREIGN PATENT DOCUMENTS

| | | |
|---|---|---|
| JP | 2013-097151 A | 5/2013 |
| JP | 2014-029397 A | 2/2014 |

* cited by examiner

*Primary Examiner* — Roy Y Yi
(74) *Attorney, Agent, or Firm* — Merchant & Gould P.C.

(57) ABSTRACT

A process cartridge includes a photosensitive drum, a developing roller, a frame, a first seal member, a second seal member, and a cleaning member. The developing roller is configured to supply developing agent to the photosensitive drum. The developing roller has a first end and a second end in an axial direction of the photosensitive drum. The first seal member is positioned between the frame and the first end of the developing roller. The first seal member has a first end inwardly in the axial direction. The second seal member is positioned between the frame and the second end of the developing roller. The second seal member has a second end inwardly in the axial direction. The cleaning member is positioned between the first end of the first seal member and the second end of the second seal member in the axial direction.

13 Claims, 6 Drawing Sheets

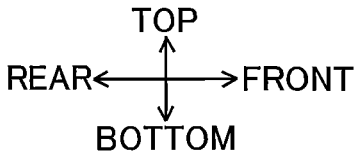
FIG.2A
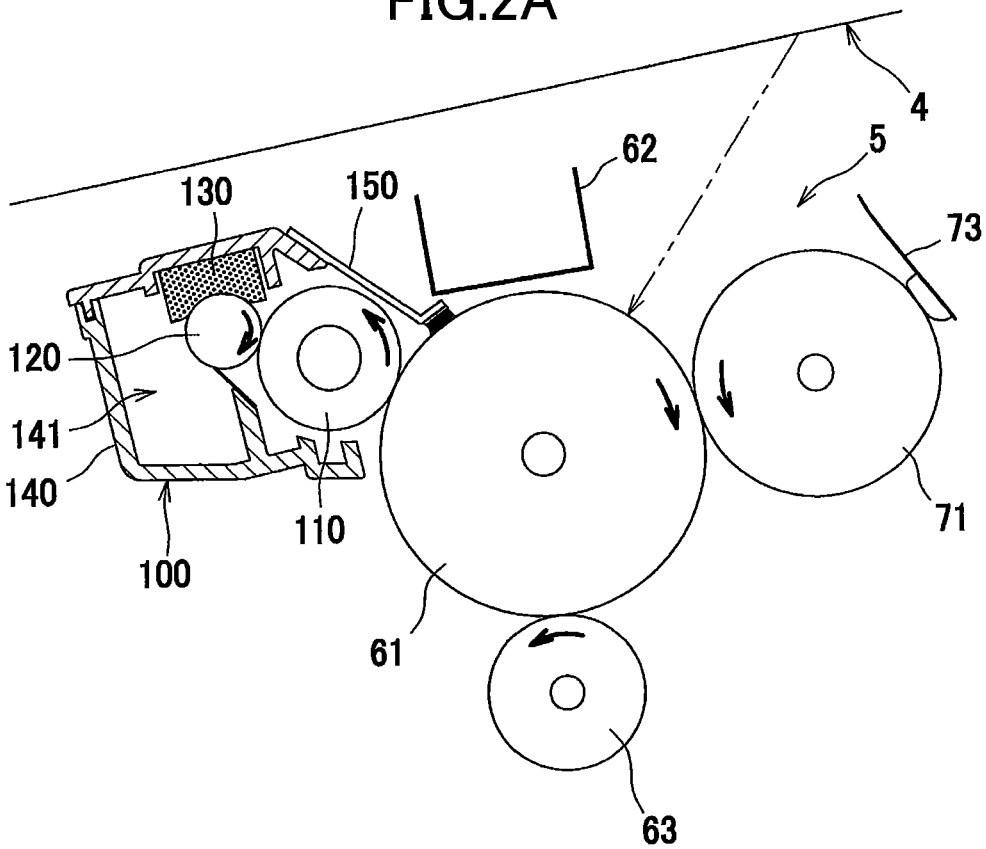
FIG.2B
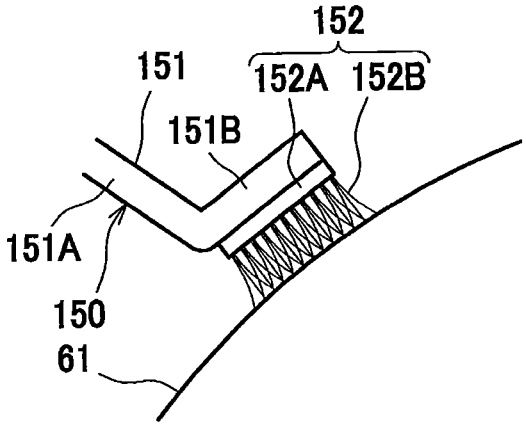

PROCESS CARTRIDGE PROVIDED WITH CLEANING UNIT

CROSS REFERENCE TO RELATED APPLICATION

This application claims priority from Japanese Patent Application No. 2014-044938 filed Mar. 7, 2014, the entire content of which is incorporated herein by reference.

TECHNICAL FIELD

The present disclosure relates to a process cartridge provided with a photosensitive drum and a developing roller.

BACKGROUND

Japanese Patent Application Publication No. 2013-97151 discloses a process cartridge provided with a photosensitive drum and a developing roller. In the process cartridge, a residual toner remaining on the photosensitive drum is collected by the developing roller. Further, a cleaning unit is provided for collecting paper dust on the photosensitive drum in order to prevent or restrain the paper dust on the photosensitive drum from being collected by the developing roller.

More specifically, the cleaning unit includes a cleaning roller applied with a collection bias which can collect the paper dust without collecting the toner, and a pressure member positioned downstream of a transfer roller in a rotational direction of the photosensitive drum and in contact with the photosensitive drum for collecting the paper dust.

SUMMARY

It is conceivable that in case where the pressure member extends to an end portion of the developing roller, toner remaining on the photosensitive drum and positioned to face the end portion of the developing roller may be broadened outwardly in an axial direction of the photosensitive drum by the pressure member.

If the broadening of the toner occurs, the outwardly broadened toner may be entered into a gap between the developing roller and a seal member in case where the seal member is provided at each end portion of the developing roller during the collection of the residual toner on the photosensitive drum by the developing roller. Thus, toner leakage may occur.

In view of the foregoing, it is an object of the disclosure to provide a process cartridge capable of restraining toner leakage.

In order to attain the above and other objects, the disclosure provides a process cartridge. The process cartridge may include a photosensitive drum, a developing roller, a frame, a first seal member, a second seal member, and a cleaning member. The photosensitive drum may have a peripheral surface configured to face a transfer roller. The photosensitive drum may be rotatable in a rotating direction. The developing roller may be configured to supply developing agent to the peripheral surface. The developing roller may define an axial direction and have a first end at a first side and a second end at a second side opposite to the first side in the axial direction. The frame may accommodate the developing roller. The first seal member may be positioned between the frame and the first end of the developing roller. The first seal member may have a first end at the first side inwardly in the axial direction. The second seal member may be positioned between the frame and the second end of the developing roller. The second seal member may have a second end at the second side inwardly in the axial direction. The cleaning member may be positioned downstream of the transfer roller and upstream of the developing roller in the rotating direction. The cleaning member may be in contact with the photosensitive drum. The cleaning member may be positioned between the first end of the first seal member and the second end of the second seal member in the axial direction.

According to another aspect, the disclosure provides a process cartridge. The process cartridge may include a photosensitive drum, a developing roller a frame, a first side seal, a second side seal, and a paper dust cleaner. The developing roller may define an axial direction and have a peripheral surface. The peripheral surface may have a first end portion at a first side and a second end portion at a second side opposite to the first side in the axial direction. The first side seal may be positioned between the frame and a first end portion of the developing roller and extend in the rotating direction. The second side seal may be positioned between the frame and the second end portion of the developing roller and extend in the rotating direction. The paper dust cleaner may be in contact with the photosensitive drum. The paper dust cleaner may be positioned between the first side seal and the second side seal.

BRIEF DESCRIPTION OF THE DRAWINGS

In the drawings:

FIG. 2A is a schematic view showing a photosensitive drum and ambient components in the process cartridge according to the embodiment;

FIG. 2B is an enlarged view of a pressure member in the process cartridge according to the embodiment;

DETAILED DESCRIPTION

A laser printer 1 provided with a process cartridge 5 according to one embodiment will be described with reference to the FIGS. 1 through 6A. First, the laser printer will be described. Throughout the specification, the terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1 in which right side and left side are front side and a rear side, respectively.

Figure 1:
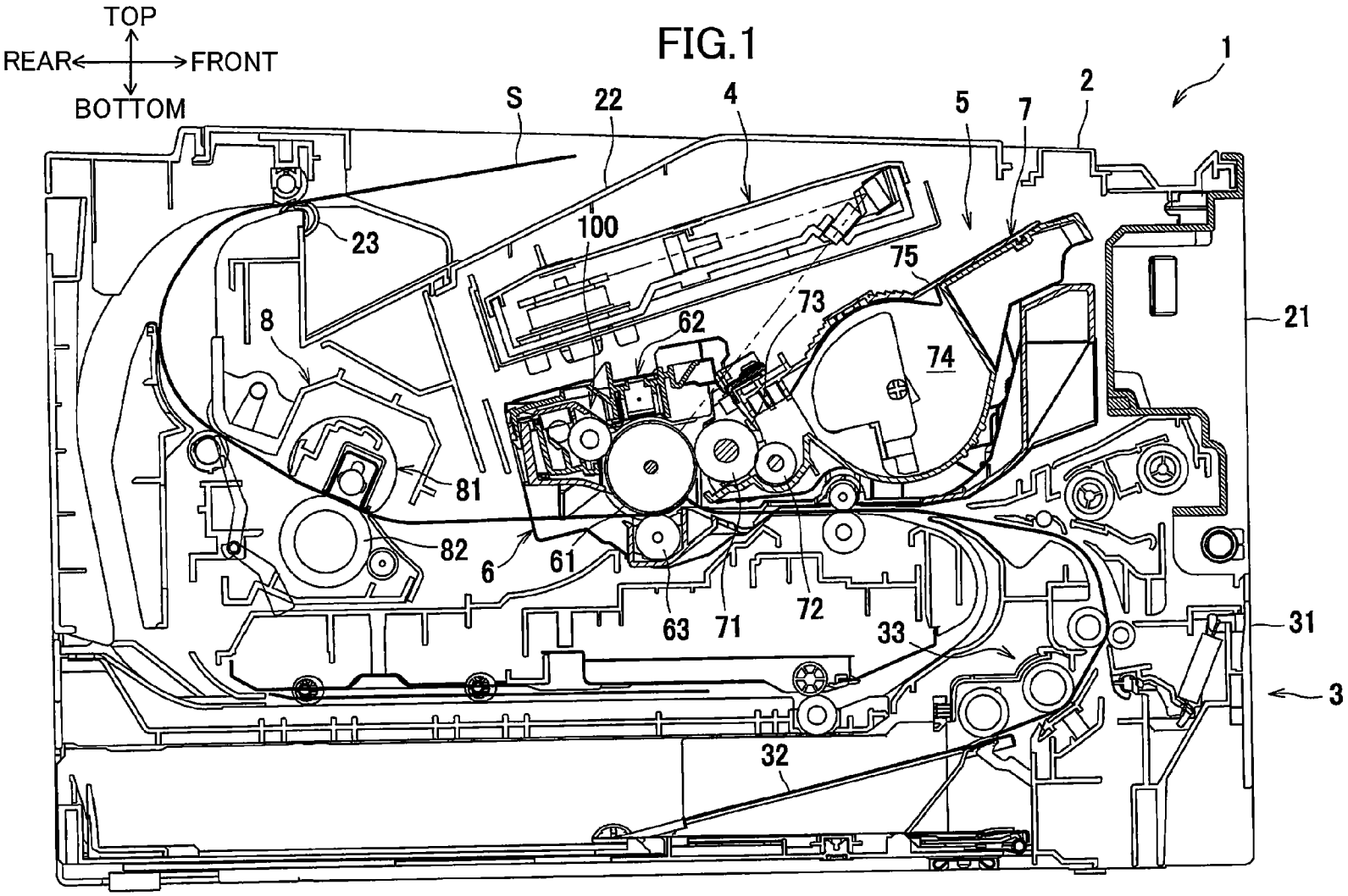
FIG. 1 is a schematic view of a laser printer provided with a process cartridge according to an embodiment.

As shown in FIG. 1, the laser printer 1 includes a housing 2, a sheet supplying unit 3 for supplying a sheet S, an exposure unit 4, a process cartridge 5 for transferring toner image onto the sheet S, a fixing unit 8 for thermally fixing toner image to the sheet S.

The sheet supplying unit 3 is positioned at a lower portion within the housing 2, and includes a sheet supply tray 31, a sheet presser plate 32, and a sheet supplying mechanism 33. The sheet S accommodated in the sheet supply tray 31 is urged upward by the sheet presser plate 32, and is supplied to the process cartridge 5 (to a position between a photosensitive drum 61 and a transfer roller 63) by the sheet supplying mechanism 33.

The exposure unit 4 is positioned at an upper portion within the housing 2, and includes a laser emitting portion (not shown), a polygon mirror, a lens, and a reflection mirror. A laser beam based on image data emitted from the laser emitting portion is subjected to high speed scanning on a peripheral surface of the photosensitive drum 61 as indicated by two dotted chain line for forming an electrostatic latent image on the peripheral surface of the photosensitive drum 61.

The housing 2 has a front opening closed by a front cover 21 pivotally movably connected to the housing 2. The process cartridge 5 is positioned below the exposure unit 4, and is configured to be attached to and detached from the hosing 2 through the front opening when the front cover 21 is open. The process cartridge 5 includes a drum cartridge 6 and a developer cartridge 7.

The drum cartridge 6 includes the photosensitive drum 61, a non-contact type scorotron charger 62 (as an example of a charger), the transfer roller 63, and a cleaning unit 100. The developer cartridge 7 is configured to be attached to and detached from the drum cartridge 6, and includes a developing roller 71, a supply roller 72, a thickness regulation blade 73, and a developing frame 75 having a toner accumulation portion 74 and configured to support these rollers 71, 72 and the thickness regulation blade 73. The toner accumulation portion 74 is adapted to accumulate positively chargeable toner. The developing frame 75 is an example of a frame.

The developing roller 71 is adapted to supply toner to the peripheral surface of the photosensitive drum 61. The developing roller 71 is in confrontation with the photosensitive drum 61 when the developer cartridge 7 is attached to the drum cartridge 6. More specifically, as shown in FIG. 2A, the developing roller 71 is configured to be rotated about its axis and in contact with the peripheral surface of the photosensitive drum 61 at a position downstream of an exposure position on the photosensitive drum 61 in a rotational direction thereof. The exposure position is a position at which the laser beam from the exposure unit 4 is impinged. Details of the developer cartridge 7 will be described later.

The transfer roller 63 is positioned downstream of the developing roller 71 in the rotational direction of the photosensitive drum 61. The scorotron charger 62 is positioned downstream of the transfer roller 63 and upstream of the developing roller 71 in the rotational direction of the photosensitive drum 61.

The cleaning unit 100 is adapted to collect paper dust deposited on the peripheral surface of the photosensitive drum 61. The cleaning unit 100 is positioned downstream of the transfer roller 63 and upstream of the scorotron charger 62 in the rotational direction of the photosensitive drum 61.

The cleaning unit 100 includes a primary cleaning roller 110 (as an example of a cleaning roller), a secondary cleaning roller 120, a scraper 130, a case 140, and a pressure member 150.

The primary cleaning roller 110 is positioned downstream of the transfer roller 63 and upstream of the pressure member 150 in the rotational direction of the photosensitive drum 61. The primary cleaning roller 110 is configured to be rotated while being in contact with the peripheral surface of the photosensitive drum 61. The primary cleaning roller 110 allows the toner on the photosensitive drum 61 to pass through the primary cleaning roller 110, while temporarily collecting paper dust on the peripheral surface of the photosensitive drum 61. More specifically, the primary cleaning roller 110 is applied with bias voltage whose polarity is the same as that of the scorotron charger 62, that is, positive polarity during image forming operation, and a surface voltage of the primary cleaning roller 110 is higher than that of the light exposed portion of the photosensitive drum 61.

The secondary cleaning roller 120 is applied with positive voltage whose absolute value is greater than the voltage applied to the primary cleaning roller 110. The secondary cleaning roller 120 is configured to be rotated while being in contact with the surface of the primary cleaning roller 110 for absorbing paper dust held by the primary cleaning roller 110.

The scraper 130 is adapted to scrape the paper dust absorbed on the surface of the secondary cleaning roller 120. The scraper 130 is made from a sponge material and is in pressure contact with the surface of the secondary cleaning roller 120.

The case 140 is adapted to accommodate therein the primary cleaning roller 110 and the secondary cleaning roller 120, and has a bottomed accumulation portion 141 for receiving paper dust removed by the scraper 130.

The pressure member 150 is positioned downstream of the transfer roller 63 and upstream of the developing roller 71 in the rotational direction of the photosensitive drum 61. More specifically, the pressure member 150 is positioned downstream of the primary cleaning roller 110 and upstream of the scorotron charger 62 in the rotational direction of the photosensitive drum 61.

The pressure member 150 is supported to the case 140, and includes a support member 151 and a flocked fabric 152 (as examples of a cleaning member and a paper dust cleaner) as shown in FIG. 2B. The pressure member 150 is adapted to collect fibrous paper dust or deposited materials on the photosensitive drum 61 yet allowing the toner to pass through the pressure member 150.

The support member 151 is a plate-like member having flexibility, and includes a fixed portion 151A fixed to the case 140 and a support portion 151B to which the flocked fabric 152 is fixed. The support portion 151B extends from tip end portion of the fixed portion 151A. Incidentally, a frame of the drum cartridge 6 has a rib (not shown) for urging a free end portion of the support member 151 toward the case 140 in order to provide stable contact of the flocked fabric 152 with the peripheral surface of the photosensitive drum 61.

The flocked fabric 152 is an example of a fabric, and includes a base fabric 152A and a flocking portion 152B implanted in the base fabric 152A. The flocked fabric 152 is configured to be in sliding contact with the photosensitive drum 61 because of the urging force of the support member 151 toward the photosensitive drum 61.

As shown in FIG. 1, in the process cartridge 5, the peripheral surface of the photosensitive drum 61 is exposed to laser beam at high scanning, after the surface is uniformly charged with positive polarity by the scorotron charger 62. Accordingly, potential of the exposed portion is lowered to provide the electrostatic latent image on the peripheral surface of the photosensitive drum 61 based on image data. Further, toner in the toner accumulation portion 74 is supplied to the developing roller 71 by way of the supply roller 72 to form a toner layer. At this time, toner is subjected to triboelectric charging to have positive polarity between the supply roller 72 and the developing roller 71. The toner layer formed on the developing roller 71 is entered into a space between the developing roller 71 and the thickness regulation blade 73, while being further subjected to triboelectric charging. Thus, a thin toner layer having a uniform thickness is carried on the developing roller 71.

The toner on the developing roller 71 is supplied from the developing roller 71 to the electrostatic latent image formed on the photosensitive drum 61. Thus, the latent image is turned into a visible toner image on the photosensitive drum 61. Thereafter, the toner image on the photosensitive drum 61 is transferred onto the sheet S when the sheet S is moved past a gap between the photosensitive drum 61 and the transfer roller 63. Paper dust deposited on the peripheral surface of the photosensitive drum 61 is collected by the cleaning unit 100.

The fixing unit 8 is positioned rearward of the process cartridge 5, and includes a heat unit 81, and a pressure roller 82. The heat unit 81 includes a halogen heater, a fixing belt, and a nip plate. The fixing belt is nipped between the pressure roller 82 and the nip plate. The toner image carried on the sheet S is thermally fixed to the sheet S when the sheet S is moved past the heat unit 81 and the pressure roller 82. The sheet S to which the toner image is thermally fixed is then discharged onto a discharge tray 22 by way of a discharge roller 23.

According to the laser printer 1, a cleaner less method is adopted in which the residual toner that has not been transferred onto the sheet S but remains on the photosensitive drum 61 is collected by the developer cartridge 7 and is re-used. More specifically, for the collection of the residual toner, the peripheral surface of the photosensitive drum 61 is subjected to charging by the scorotron charger 62 so as to provide electrical potential at the peripheral surface of the photosensitive drum 61 higher than that of the developing roller 71. Accordingly, residual toner charged with positive polarity on the peripheral surface of the photosensitive drum 61 can be displaced onto the developing roller 71, and the toner is returned into the toner accumulation portion 74.

Figure 3:
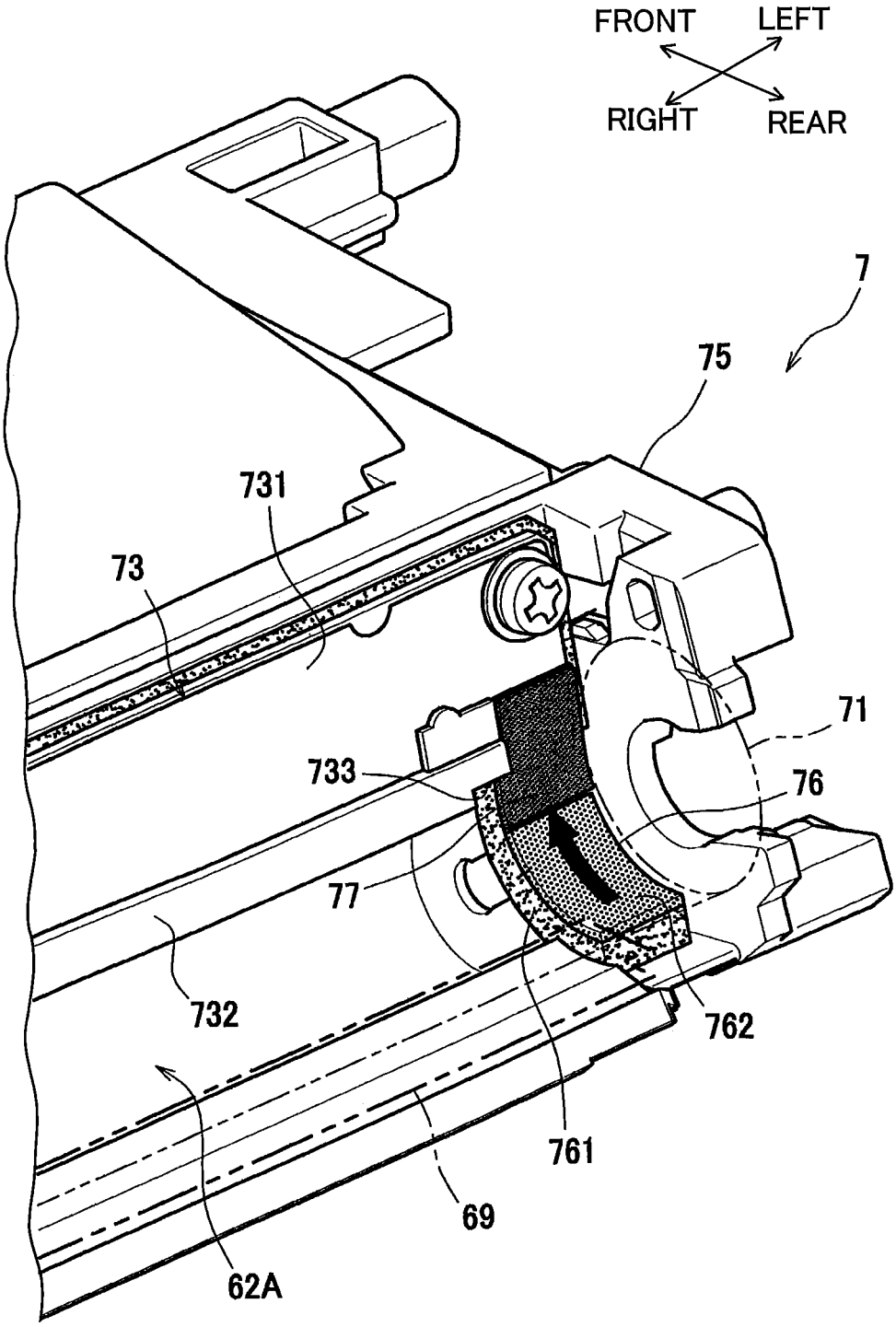
FIG. 3 is a partial perspective view of a left end portion of a developing cartridge in the process cartridge according to the embodiment.

Next, detail configuration of the developer cartridge 7 will be described. As shown in FIG. 3, the developing frame 75 has a rear wall formed with an opening 62A, and the developing roller 71 is positioned to close the opening 62A. A side seal member 76 (as examples of first and second seal members, and first and second side seals) is provided at each widthwise end portion of the developing frame 75 corresponding to each axial end portion of the developing roller 71. The term widthwise end portion implies left end portion and right end portion of the developing frame 75. Thus, each side seal member 76 is positioned between each widthwise end portion of the developing frame 75 and each axial end portion of the developing roller 71 for avoiding toner leakage through the boundary between the axial end portion of the developing roller 71 and the developing frame 75. Further, a film member 69 extends over a longitudinal edge portion of the opening 62A at a position blow the developing roller 71. Thus toner leakage from a boundary between the lower portion of the developing roller 71 and the developing frame 75 can be avoided.

Figure 4A:
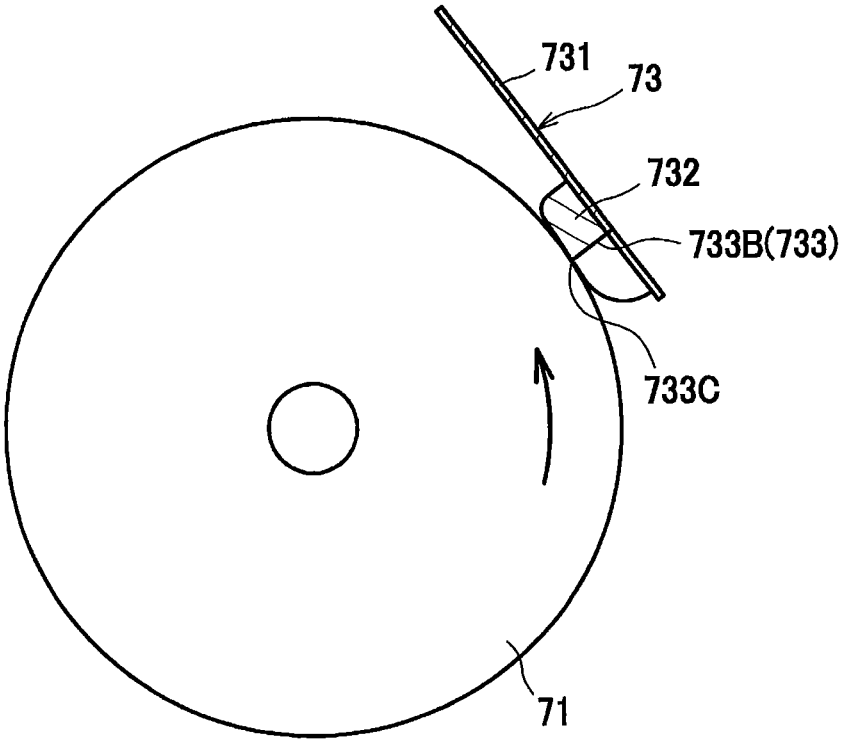
FIG. 4A is a cross-sectional view of a thickness regulation blade and a developing roller in the developing cartridge taken along an imaginary plane passing through a notched portion of the thickness regulation blade according to the embodiment.

The thickness regulation blade 73 is adapted to regulate a thickness of the toner layer carried on the developing roller 71, and has a base end portion fixed to the developing frame 75 at a position above the developing roller 71 and has a free end portion positioned frontward of the developing roller 71. As shown in FIGS. 3 and 4A, the thickness regulation blade 73 includes a blade base 731 made from metal and extending in a widthwise direction ("widthwise direction" implies an axial direction of the developing roller 71), and a contact portion 732 protruding from a surface of the blade base 731, the surface being in confrontation with the developing roller 71. The thickness regulation blade 73 has a right end portion and a left end portion each being provided with a blade seal member 77 (as examples of first and second blade seal, and first and second blade seal members).

The contact portion 732 is made from a rubber, and is fixed to the free end portion of the blade base 731 while contacting the peripheral surface of the developing roller 71. The contact portion 732 has a right end portion and a left end portion each being formed with a notched portion 733. One of the right end portion and the left end portion of the contact portion 732 is an example of one of a first end portion and a second end portion of a contact portion, and another of the right end portion and the left end portion of the contact portion 732 is an example of another of the first end portion and the second end portion. The notched portions 733 are examples of first and second notched portions.

Figure 4B:
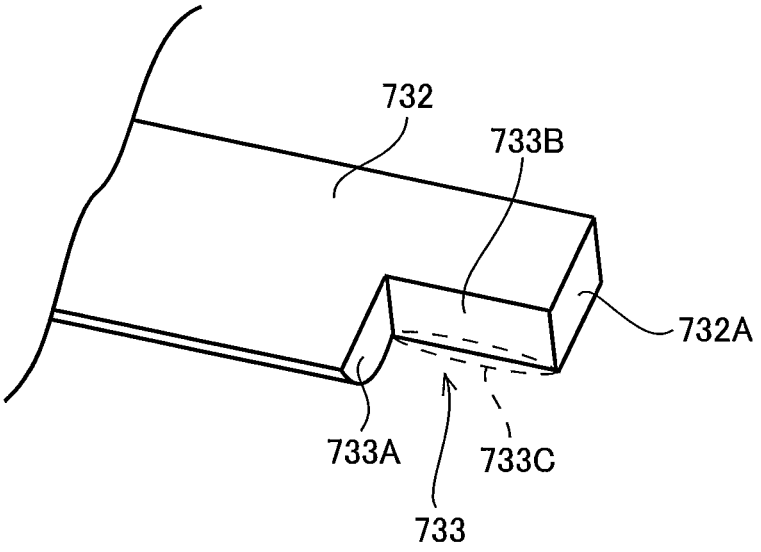
FIG. 4B is a perspective view of a flocked fabric in the process cartridge according to the embodiment.
Figure 5:
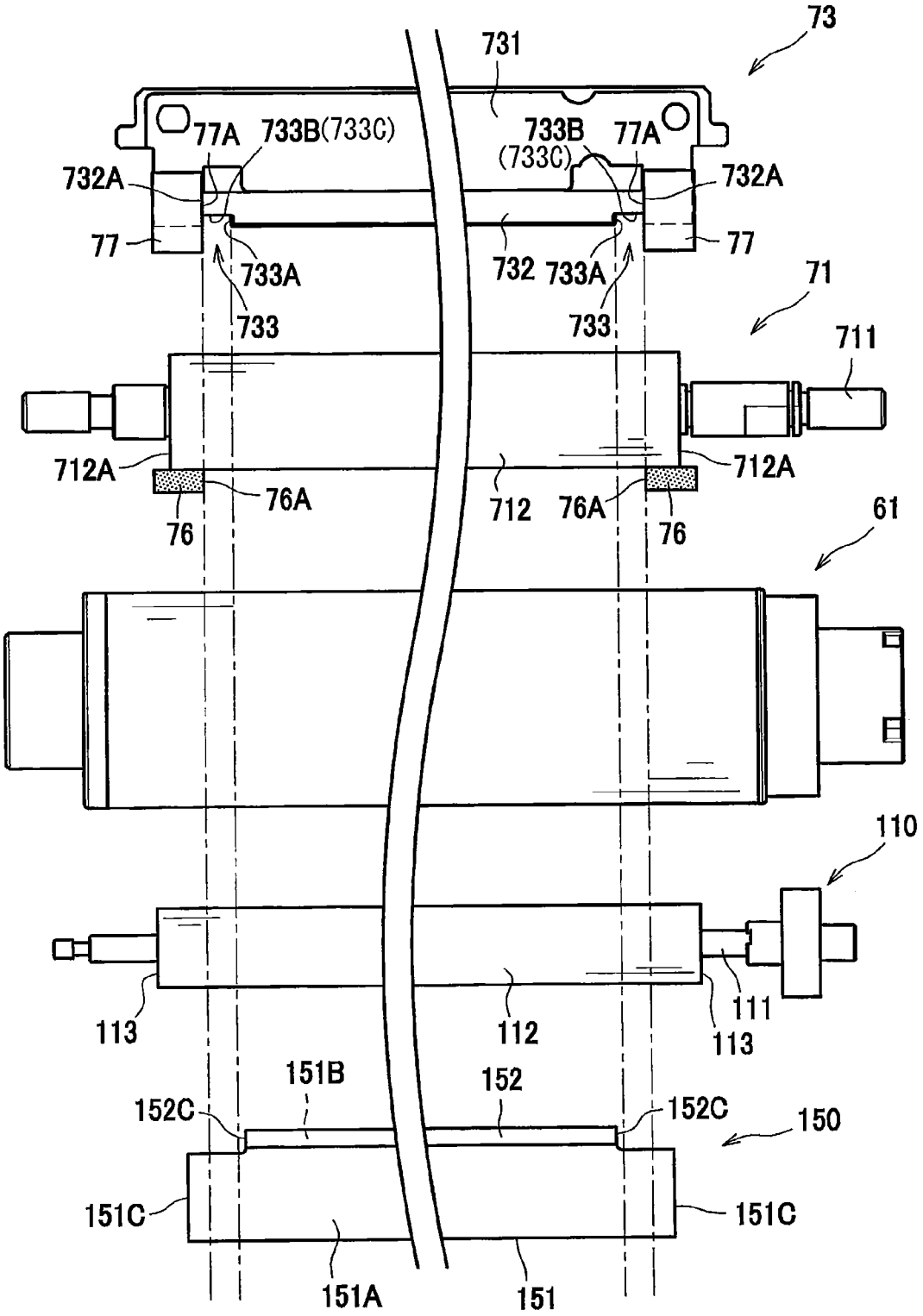
FIG. 5 is a view for description of dimensional and positional relationship among the thickness regulation blade, the developing roller, the photosensitive drum, a primary cleaning roller, and the pressure member according to the embodiment.

The notched portion 733 is recessed from a tip end of the thickness regulation blade 73 toward the base end portion, and is also recessed inward from a leftmost end and a rightmost end of the thickness regulation blade 73. That is, as shown in FIGS. 4B and 5, the notched portion 733 is outlined by a first edge 733A (as examples of a first end of a first notched portion and a second end of a second notched portion) extending upward from a lower edge of the contact portion 732, and a second edge 733B extending from an upper end of the notched portion 733 outwardly in leftward/rightward direction to reach the right end and left end 732A of the contact portion 732.

With the thickness regulation blade 73 thus constructed, a flat surface of the contact portion 732 at a position between the left and right notched portions 733 is in contact with the peripheral surface of the developing roller 71. The flat surface is an example of a remaining portion. Each angled portion 733C defined by an intersection between the second edge 733B and the surface of the contact portion 732 as depicted by encircled dot-line in FIG. 4B is in contact with each axial end portion of the developing roller 71.

As shown in FIG. 3, the blade seal member 77 is adjacent to the contact portion 732 at a position outward of the contact portion 732 in leftward/rightward direction, and is adhered to the blade base 731. The blade seal member 77 is made from a non-woven fabric. The blade seal member 77 extends outward to exceed the free end portion of the blade base 731 in the axial direction of the developing roller 71 and in contact with the peripheral surface of each axial end portion of the developing roller 71.

The side seal member 76 includes a base material 761 fixed to the developing frame 75 and made from an elastic material, and a surface material 762 formed over the base material 761 and confronting the axial end portions of the developing roller 71. The side seal member 76 extends from an end portion of the blade seal member 77 and is curved in conformance with a curvature of the peripheral surface of the developing roller 71. The side seal member 76 contacts the axial end portions of the developing roller 71.

Next, dimensional and positional relationship among the developing roller 71, the thickness regulation blade 73, the photosensitive drum 61, the primary cleaning roller 110, and the pressure member 150 will be described with reference to FIG. 5.

The developing roller 71 includes a roller shaft 711 extending in the axial direction, i.e., the leftward/rightward direction, and a roller body 712 disposed over the roller shaft 711.

The roller body 712 has a length in leftward/rightward direction smaller than that of the photosensitive drum 61. The roller body 712 is so positioned that each end portion 712A (as examples of first and second ends of a developing roller) of the roller body 712 is in contact with the peripheral surface of the photosensitive drum 61.

The contact portion 732 of the thickness regulation blade 73 has a length in leftward/rightward direction smaller than that of the roller body 712. Each end 732A of the contact portion 732 in the leftward/rightward direction is positioned inward of the end portion 712A of the roller body 712 in the leftward/rightward direction. In other words, each notched portion 733 of the thickness regulation blade 73 is positioned at each end portion of the peripheral surface of the roller body 712.

The side seal member 76 has a width in leftward/rightward direction approximately the same as that of the blade seal member 77, and these seal members 76 and 77 are aligned with each other in the leftward/rightward direction. Each side seal member 76 has an inner edge 76A (as examples of first and second ends of first and second seal members) and each blade seal member 77 has an inner edge 77A (as examples of first and second ends of first and second blade seal members) in leftward/rightward direction. These inner edges 76A and 77A are positioned inward of each end portion 712A of the roller body 712 in leftward/rightward direction, and in alignment with the end 732A of the contact portion 732 of the thickness regulation blade 73.

The fixed portion 151A of the pressure member 150 has each end 151C (as examples of first and second ends of a support member), each being positioned outward of the support portion 151B and the flocked fabric 152 in leftward/rightward direction. Further, each end 151C is positioned outward of the inner edge 76A of the side seal member 76 in leftward/rightward direction.

The flocked fabric 152 has each end 152C, each being positioned inward of the inner edge 76A of the side seal member 76 in leftward/rightward direction. That is, the flocked fabric 152 is positioned between the side seal members 76 in leftward/rightward direction. Further, each end 152C of the flocked fabric 152 is positioned inward of each inner edge (the first edge 733A) of the notched portion 733 of the thickness regulation blade 73 in leftward/rightward direction. That is, the flocked fabric 152 is positioned between the notched portions 733 of the thickness regulation blade 73 in leftward/rightward direction. Further, each end 152C of the flocked fabric 152 is positioned outward of an image forming region in which the electrostatic latent image is formed of the photosensitive drum 61 in leftward/rightward direction.

Each notched portion 733 is positioned between the side seal members 76 in leftward/rightward direction. The flocked fabric 152 is positioned between the blade seal members 77 in leftward/rightward direction.

The primary cleaning roller 110 includes a cleaning shaft 111 extending in leftward/rightward direction, and a roller portion 112 disposed over the cleaning shaft 111. The roller portion 112 is longer than the flocked fabric 152 in leftward/rightward direction, and each end 113 (as examples of first and second ends of a cleaning roller) of the roller portion 112 is positioned outward of each end 152C of the flocked fabric 152 in leftward/rightward direction. That is, each end 113 of the roller portion 112 is positioned outward of the flocked fabric 152 in the leftward/rightward direction, i.e., the flocked fabric 152 is positioned between the ends 113 of the roller portion 12 in the leftward/rightward direction. Further, each end 113 of the roller portion 112 is positioned outward of each inner edge 76A of the side seal member 76 in leftward/rightward direction.

Next, operation and advantageous effects in the process cartridge 5 will be described. As shown in FIGS. 4A and 4B, during image forming operation, toner on the developing roller 71 is scraped off by the contact portion 732 of the thickness regulation blade 73 upon the rotation of the developing roller 71.

In this case, the flat surface of the contact portion 732 positioned between two notched portions 733 is in contact with the developing roller 71, whereas a corner of each angled portion 733C of each notched portion 733 is in contact with the developing roller 71. More specifically, the flat surface of the contact portion 732 positioned between two notched portions 733 has an arcuate or rounded tip end in cross-section for scraping the toner as shown in FIGS. 4A and 4B, whereas the notched portion 733 has the second edge 733B extending radially and vertically for scraping the toner. Consequently, the notched portions 733 provide scraping performance higher than that of a portion other than the notched portion 733. The developing roller 71 has each end surface portion corresponding to the notched portion 733 and a remaining surface portion corresponding to the flat surface, i.e., a portion inward of each end surface portion in leftward/rightward direction, and toner scraped amount at each end surface portion is greater than that at the remaining surface portion. Thus, the toner layer at each end surface portion has a thickness smaller than that at the remaining surface portion.

However, with a prolonged use of the process cartridge 5, the contact portion 732 becomes worn, so that the angled portion 733C of the notched portion 733 is subjected to shaving. Thus, sufficient toner scraping function at the notched portion 733 cannot be performed. Accordingly, thickness of the toner layer at each end surface portion of the developing roller 71 is increased. Due to such thick toner, toner may remain on the photosensitive drum 61 as a residual toner after the thick toner is transferred onto the photosensitive drum 61.

Figure 6A:
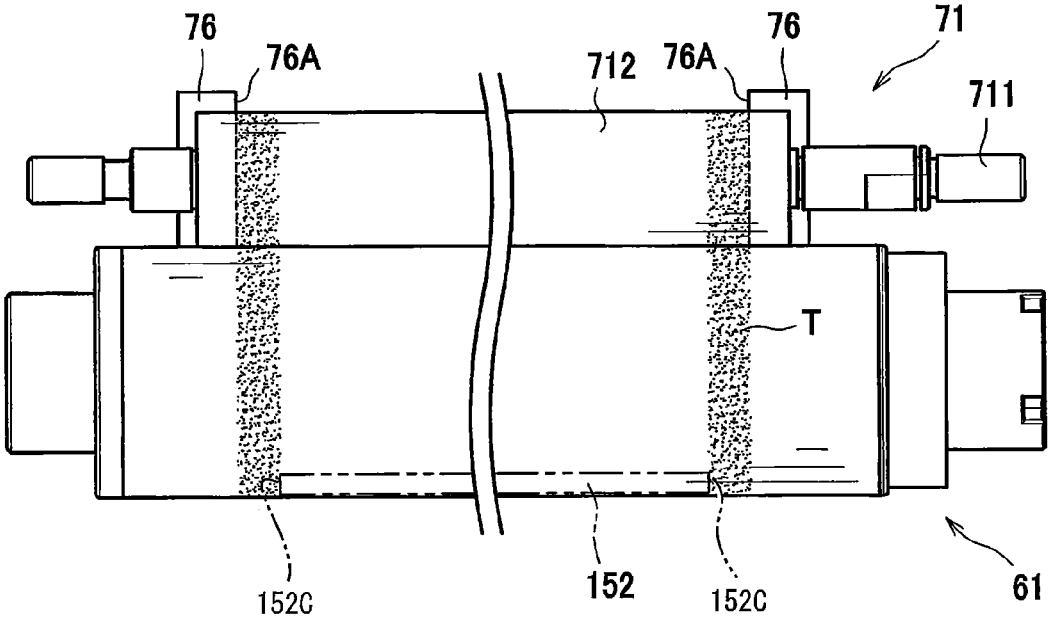
FIG. 6A is a view for description of operation in the process cartridge according to the embodiment.
Figure 6B:
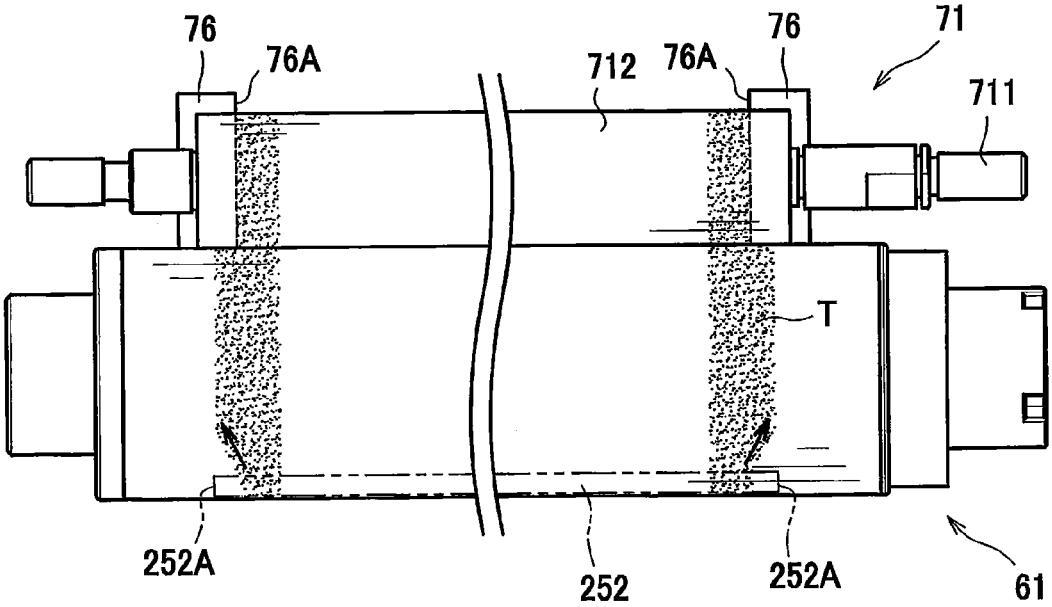
FIG. 6B is a view for description of operation in a process cartridge according to a comparative example.

FIG. 6B shows a comparison case relative to the embodiment. In the comparison case, the pressure member 150 includes a flocked fabric 252 having each end 252A in leftward/rightward direction. The flocked fabric 252 has a lateral dimension longer than a lateral dimension of the flocked fabric 152 in the embodiment. That is, each end 252A of the flocked fabric 152 is positioned outward of each end 152C of the flocked fabric 252 in leftward/rightward direction.

In such a situation, if each end 252A of the flocked fabric 252 in leftward/rightward direction is positioned outward of the inner edge 76A of the side seal member 76 in leftward/rightward direction, toner T that has been transferred from each end surface portion corresponding to each notched portion 733 to the photosensitive drum 61 will be broadened by the flocked fabric 252 and exceeds outward in leftward/rightward direction from the inner edge 76A of the side seal member 76 in leftward/rightward direction as indicated by an arrow in FIG. 6B. As a result, during toner collection from the photosensitive drum 61 by the developing roller 71, the toner T broadened by the flocked fabric 252 may be entered between the side seal member 76 and the developing roller 71, causing toner leakage.

On the other hand, in accordance with a present embodiment as shown in FIG. 6A, each end 152C of the flocked fabric 152 in leftward/rightward direction is positioned inward of the inner edge 76A of the side seal member 76 in leftward/rightward direction. This structure can restrain or prevent toner T that has been transferred from each end surface portion corresponding to each notched portion 733 to the photosensitive drum 61 from being broadened and exceeding outward, by the flocked fabric 152, in leftward/rightward direction from each inner edge 76A of the side seal member 76. Accordingly, during toner collection from the photosensitive drum 61 by the developing roller 71, invasion of toner T between the side seal member 76 and the developing roller 71 can be prevented, thereby avoiding toner leakage. Similarly, invasion of toner between the blade seal member 77 and the developing roller 71 can be prevented, thereby avoiding toner leakage.

Further, each end 152C of the flocked fabric 152 in leftward/rightward direction is positioned inward of each inner end portion of the notched portion 733, i.e., the first edge 733A in leftward/rightward direction. Therefore, the flocked fabric 152 is isolated from toner T carried on the photosensitive drum 61 at a position corresponding to the notched portion 733, as shown in chain-line of FIG. 5. This structure can restrain or prevent toner T that has been carried on the photosensitive drum 61 at a position corresponding to the notched portion 733 from being broadened outward in leftward/rightward direction, thereby restraining toner leakage.

Incidentally, in spite of reduction in length of the flocked fabric 152 in leftward/rightward direction, paper dust deposited on the photosensitive drum 61 at a position corresponding to a non-contact portion with the flocked fabric 152 can be collected by the primary cleaning roller 110, because each end 113 of the roller portion 112 of the primary cleaning roller 110 in leftward/rightward direction is positioned outward of each inner edge 76A of the side seal member 76 in leftward/rightward direction. Further, paper dust can be collected in the roller portion 112 in comparison with the flocked fabric 152 in spite of small pressing force to the photosensitive drum 61 because bias voltage is applied to the roller portion 112. Accordingly, outward broadening of the toner by the roller portion 112 does not occur even if each end 113 of the roller portion 112 in leftward/rightward direction is positioned outward of each inner edge 76A of the side seal member 76 in leftward/rightward direction.

Further, since each end 151C of the fixed portion 151A is positioned outward of each inner edge 76A of the side seal member 76 in leftward/rightward direction, the fixed portion 151A can prevent the toner from flying toward the scorotron charger 62 even if the toner on the photosensitive drum 61 is released therefrom due to the contact of the primary cleaning roller 110 and the flocked fabric 152 with the photosensitive drum 61. Accordingly, contamination of the scorotron charger 62 with the toner can be restrained.

Various modifications are conceivable. For example, in the above-described embodiment, each end 152C of the flocked fabric 152 in leftward rightward direction is positioned inward of each inner end portion of the notched portion 733 of the thickness regulation blade 73 in leftward/rightward direction, i.e., the first edge 733A. However, each end 152C can be positioned inward of each inner edge 76A of the side seal member 76 in leftward/rightward direction, and outward of the first edge 733A.

Further, in the above-described embodiment, the flocked fabric 152 is employed as the cleaning member and the paper dust cleaner. However, other fabric such as non-woven fabric is available. Further, a brush is also available as the cleaning member and the paper dust cleaner. In the latter case, tip end of the brush is in sliding contact with the photosensitive drum in pressure contact therewith.

Further, in the above-described embodiment, the transfer roller 63 is provided in the process cartridge 5. However, the transfer roller can be provided separately from the process cartridge 5, and can be supported by the housing 2.

Further, in the above-described embodiment, the side seal members 76 are in contact with the end portions 712A of the roller body 712, respectively. However, the side seal members 76 may be positioned inside the end portions 712 of the roller body 712 in the leftward/rightward direction.

While the description has been made in detail with reference to the above-described embodiments thereof, it would be apparent to those skilled in the art that various changes and modifications may be made therein without departing from the spirit of the above described aspect.

What is claimed is:

1. A process cartridge comprising:

a photosensitive drum having a peripheral surface configured to face a transfer roller, the photosensitive drum being rotatable in a rotating direction;

a developing roller configured to supply developing agent to the peripheral surface, the developing roller defining an axial direction and having a first end at a first side and a second end at a second side opposite to the first side in the axial direction;

a frame accommodating the developing roller;

a first seal member positioned between the frame and the first end of the developing roller, the first seal member having a first end at the first side inwardly in the axial direction;

a second seal member positioned between the frame and the second end of the developing roller, the second seal member having a second end at the second side inwardly in the axial direction;

a cleaning roller positioned downstream of the transfer roller in the rotating direction and including a roller portion in contact with the peripheral surface of the photosensitive drum, the cleaning roller being configured to allow the developing went on the peripheral surface of the photosensitive drum to pass through the cleaning roller and to collect paper dust on the peripheral surface of the photosensitive drum, the roller portion having a length in the axial direction longer than a distance in the axial direction between the first end of the first seal member and the second end of the second seal member; and a cleaning fabric positioned downstream of the cleaning roller and upstream of the developing roller in the rotating direction, the cleaning fabric being in contact with the peripheral surface of the photosensitive drum, the cleaning fabric being configured to allow the developing agent on the peripheral surface of the photosensitive drum to pass through the cleaning fabric and to collect the paper dust on the peripheral surface of the photosensitive drum, the cleaning fabric having a length in the axial direction smaller than the distance in the axial direction between the first end of the first seal member and the second end of the second seal member.

2. The process cartridge as claimed in claim 1, further comprising a thickness regulation blade configured to regulate a thickness of a layer of the developing agent formed on the developing roller, the thickness regulation blade comprising:

a blade base extending in the axial direction and having a surface facing the developing roller; and a contact portion protruding from the surface of the blade base and in contact with the developing roller, the contact portion comprising:

a first end portion positioned at the first side in the axial direction and formed with a first notched portion, the first notched portion being positioned inward of the first end of the first seal member in the axial direction;

a second end portion positioned at the second side in the axial direction and formed with a second notched portion, the second notched portion being positioned inward of the second end of the second seal member in the axial direction; and a remaining portion other than the first notched portion and the second notched portion, wherein the first notched portion and the second notched portion are configured to provide scraping performance for scraping the developing agent on the developing roller higher than that of the remaining portion, wherein the first notched portion has a first end at the first side inwardly in the axial direction, wherein the second notched portion has a second end at the second side inwardly in the axial direction, wherein the cleaning fabric is positioned between the first end of the first notched portion and the second end of the second notched portion in the axial direction.

3. The process cartridge as claimed in claim 2, wherein each of the first the notched portion and the second notched portion has a corner in contact with the developing roller and the remaining portion has a flat surface in contact with the developing roller.

4. The process cartridge as claimed in claim 2, further comprising:

a first blade seal member positioned between the developing roller and the thickness regulation blade, the first blade seal member having a first end at the first side inwardly in the axial direction; and a second blade seal member positioned between the developing roller and the thickness regulation blade, the second blade seal member having a second end at the second side inwardly in the axial direction, wherein the cleaning fabric is positioned between the first end of the first blade seal member and the second end of the second blade seal member.

5. The process cartridge as claimed in claim 1, further comprising:

a charger positioned downstream of the cleaning fabric and upstream of the developing roller in the rotating direction, and configured to charge the peripheral surface of the photosensitive drum;

wherein the cleaning roller is configured to collect the paper dust on the peripheral surface of the photosensitive drum by application to the cleaning roller with a bias voltage whose polarity is the same as that applied to the charger.

6. The process cartridge as claimed in claim 5, further comprising a support member extending in the axial direction and positioned downstream of the transfer roller and upstream of the charger, the support member being configured to support the cleaning fabric, the support member having a first end at the first side and a second end at the second side in the axial direction, wherein the first end of the support member is positioned outward of the first end of the first seal member in the axial direction, and the second end is positioned outward of the second end of the second seal member in the axial direction.

7. A process cartridge comprising:

a photosensitive drum rotatable in a rotating direction;

a developing roller defining an axial direction and having a peripheral surface, the peripheral surface having a first end portion at a first side and a second end portion at a second side opposite to the first side in the axial direction;

a frame;

a first side seal positioned between the frame and the first end portion of the developing roller and extending in the rotating direction;

a second side seal positioned between the frame and the second end portion of the developing roller and extending in the rotating direction;

a cleaning, roller positioned downstream of the developing roller in the rotating direction and including a roller portion in contact with the photosensitive drum, the cleaning roller being configured to allow developing agent on the photosensitive drum to pass through the cleaning roller and to collect paper dust on the photosensitive drum, the roller portion having a length in the axial direction longer than a distance in the axial direction between the first side seal and the second side seal; and a paper dust cleaner positioned downstream of the cleaning roller and upstream of the developing roller in the rotating direction, the paper dust cleaner being in contact with the photosensitive drum, the paper dust cleaner being configured to allow the developing agent on the photosensitive drum to pass through the paper dust cleaner and to collect the paper dust on the photosensitive drum, the paper dust cleaner having a length in the axial direction smaller than the distance in the axial direction between the first side seal and the second side seal.

8. The process cartridge as claimed in claim 7, wherein the paper dust cleaner is a fabric.

9. The process cartridge as claimed in claim 7, further comprising a thickness regulation blade configured to regulate a thickness of a layer of developing agent formed on the developing roller, the thickness regulation blade comprising:

a blade base extending in the axial direction;

a contact portion protruding from the blade base and in contact with the developing roller, the contact portion having:

a first notched portion;

a second notched portion; and a remaining portion between the first notched portion and the second notched portion in the axial direction, wherein the paper dust cleaner is positioned between the first notched portion and the second notched portion in the axial direction.

10. The process cartridge as claimed in claim 9, wherein the first and second notched portions are positioned between the first side seal and the second side seal in the axial direction.

11. The process cartridge as claimed in claim 9, further comprising:

a first blade seal positioned between the developing roller and the thickness regulation blade; and a second blade seal positioned between the developing roller and the thickness regulation blade, wherein the paper dust cleaner is positioned between the first blade seal and the second blade seal in the axial direction.

12. The process cartridge as claimed in claim 7, further comprising:

a charger configured to charge the photosensitive drum;

wherein the paper dust cleaner is positioned between the cleaning roller and the charger in the rotating direction.

13. A process cartridge comprising:

a photosensitive drum having a peripheral surface configured to face a transfer roller, the photosensitive drum being rotatable in a rotating direction;

a developing roller configured to supply developing agent to the peripheral surface, the developing roller defining an axial direction and having a first end at a first side and a second end at a second side opposite to the first side in the axial direction;

a frame accommodating the developing roller;

a first seal member positioned between the frame and the first end of the developing roller, and the first seal member having a first end at the first side inwardly in the axial direction;

a second seal member positioned between the frame and the second end of the developing roller, and the second seal member having a second end at the second side inwardly in the axial direction;

a cleaning roller positioned downstream of the transfer roller in the rotating direction and including a roller portion which is in contact with the peripheral surface of the photosensitive drum, the cleaning roller being configured to allow the developing agent on the peripheral surface of the photosensitive drum to pass through the cleaning roller and to collect paper dust on the peripheral surface of the photosensitive drum, the roller portion having a length in the axial direction longer than a distance in the axial direction between the first end of the first seal member and the second end of the second seal member; and a cleaning brush positioned downstream of the cleaning roller and upstream of the developing roller in the rotating direction, the cleaning brush being in contact with the photosensitive drum, the cleaning brush being configured to allow the developing agent on the peripheral surface of the photosensitive drum to pass through the cleaning brush and to collect paper dust on the peripheral surface of the photosensitive drum, the cleaning brush having a length in the axial direction smaller than the distance in the axial direction between the first end of the first seal member and the second end of the second seal member.

* * * * *